United States Patent [19]

Sparkman

[11] 3,954,246

[45] May 4, 1976

[54] BOOK HOLDER

[76] Inventor: Virgil M. Sparkman, 3003 Duff Drive, Arlington, Tex. 76010

[22] Filed: July 12, 1974

[21] Appl. No.: 487,887

Related U.S. Application Data

[63] Continuation of Ser. No. 210,734, Dec. 22, 1971, abandoned.

[52] U.S. Cl. ..... 248/453; 248/460

[51] Int. Cl.[2] ..... A47B 97/04

[58] Field of Search ..... 248/453, 447, 456, 455, 248/460, 441, 465, 451, 457, 458, 445, 463, 464, 446, 454, 462

[56] References Cited

UNITED STATES PATENTS

| | | | |
|---|---|---|---|
| 992,509 | 5/1911 | Kobzy | 248/453 |
| 1,147,589 | 7/1915 | Allen | 248/458 |
| 2,503,015 | 4/1950 | Weisheit | 248/453 |
| 2,834,149 | 5/1958 | Flahive et al. | 248/445 |
| 3,417,954 | 12/1968 | Croninger | 248/462 |

*Primary Examiner*—Roy D. Frazier
*Assistant Examiner*—Robert A. Hafer
*Attorney, Agent, or Firm*—Peter J. Murphy

[57] ABSTRACT

A stand for supporting an open book in an upright reading position on a horizontal surface, includes a base frame and a book support assembly together defining a book supporting plane supported at a desired angle relative to the table. The support assembly is pivotally supported on the base frame about a generally vertical axis, and includes structure for supporting the weight of the book. The base frame includes page holding arms, pivotable in the book supporting plane to be engaged by the open pages of the book; and the support assembly includes spring arm means engaging the backs of the book covers to urge the covers and pages into engagement with the page holding arms. The support assembly is rotatable 180° relative to the base frame to support the book in either of two alternative positions in the book supporting plane, the book being rearwardly inclined in one position and forwardly inclined in the alternative position. The stand is foldable to a generally flat condition for convenient storage and transport.

10 Claims, 13 Drawing Figures

Fig. 1
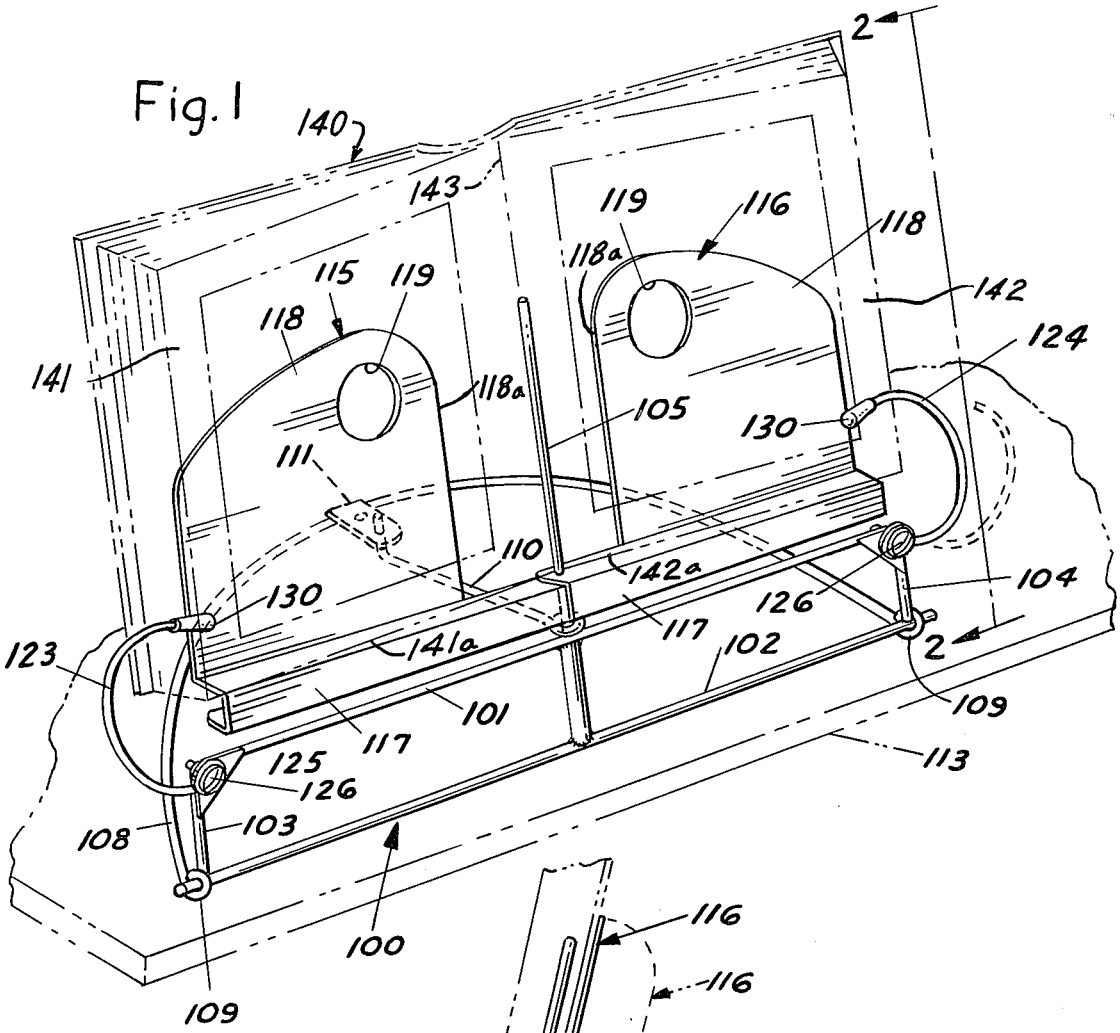
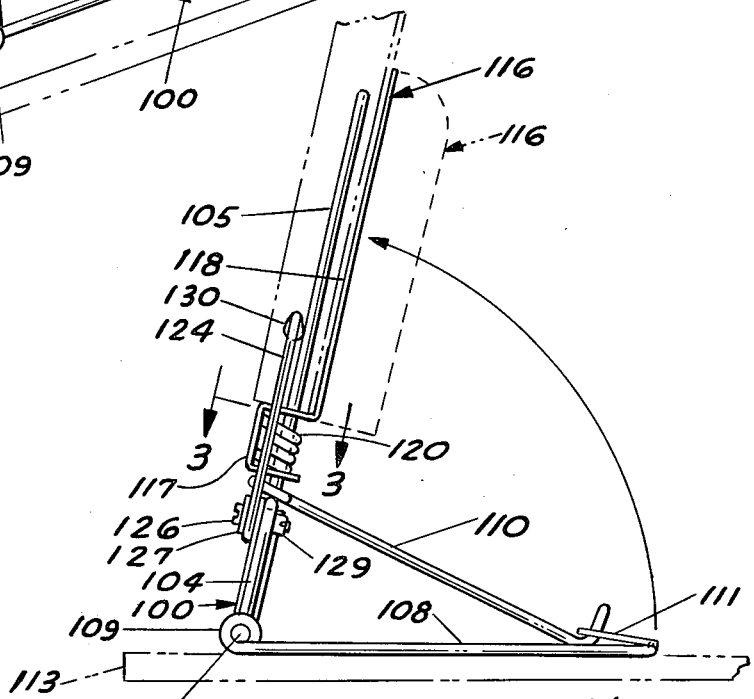
Fig. 2
INVENTOR
Virgil M. Sparkman
BY
Cecil L. Wood
Peter J. Murphy
ATTORNEYS INVENTOR
Virgil M. Sparkman
BY
Cecil L. Wood
Peter J. Murphy
ATTORNEYS

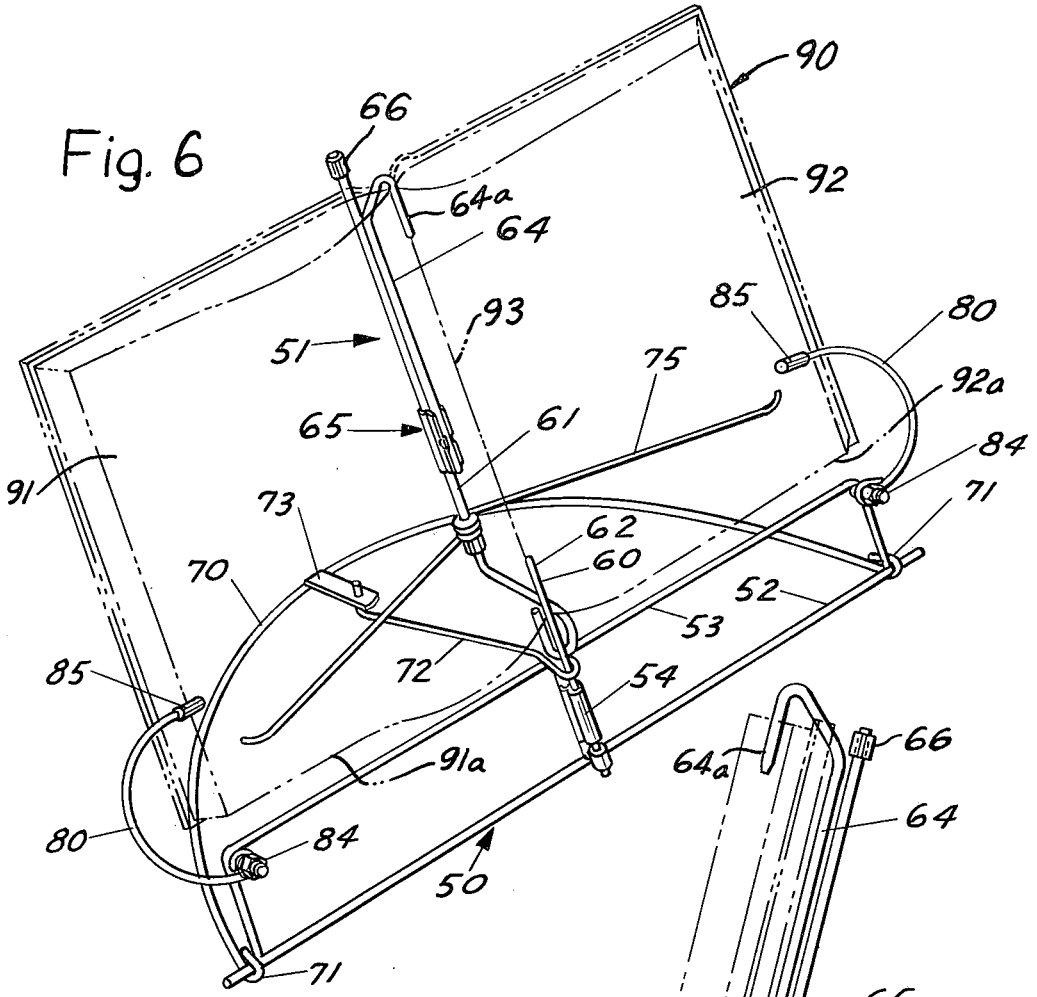
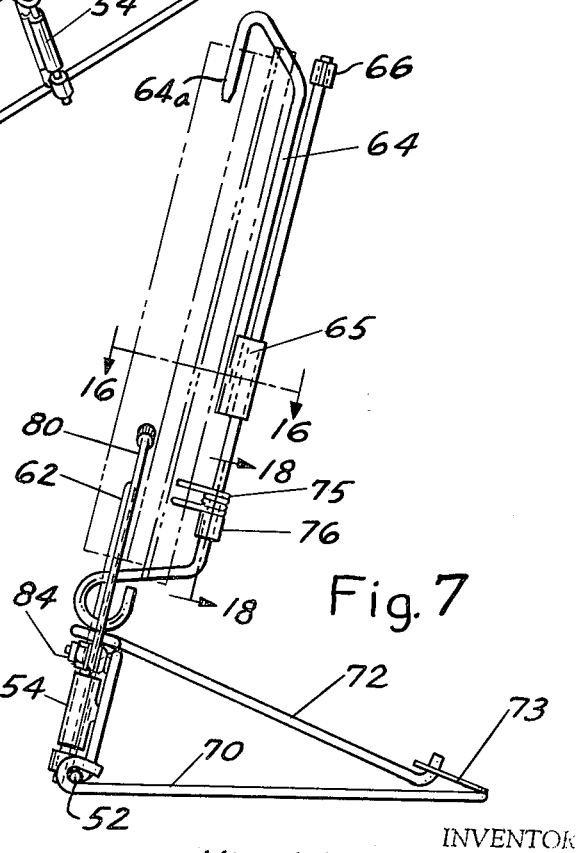
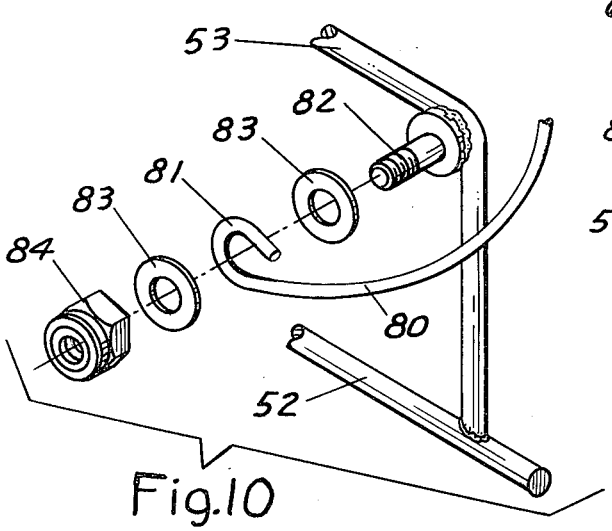
INVENTOR
Virgil M. Sparkman
Cecil L. Rose
BY Peter J. Murphy
ATTORNEYS INVENTOR
Virgil M. Sparkman BY
Cecil L. Wood
Peter J. Murphy
ATTORNEYS

BOOK HOLDER

This is a continuation of application Ser. No. 210,734 filed Dec. 22, 1971.

BACKGROUND AND SUMMARY OF THE INVENTION

This invention relates to a book holding device, and more particularly to a collapsible supporting stand to support an open book in upright readable position on a table surface.

An object of this invention is to provide a light and economical book holder especially useful for students, librarians, researchers, invalids and individuals in similar pursuits and circumstances for supporting a hard or soft bound book, or other publication, in reading position while freeing the hands for making written notes and the like.

Another object of this invention is to provide a book holder of this type which is adjustable to accommodate books of various sizes.

A further object of this invention is to provide a book holder of this type which may be disassembled and/or collapsed for compact storage.

Still another object of this invention is to provide a book holder of this type for supporting a book, either in the usual rearwardly inclined position, or in a forwardly inclined position for reading from a reclining position.

Broadly, a book holder according to the invention includes a horizontally elongated frame defining a supporting plane for the book, including pivot means disposed in a central upright axis in the supporting plane. Support means mounted on the frame support the frame in a plane inclined from the vertical. A pair of page holding arms are pivotally mounted on the frame to swing within the supporting plane, and are disposed to extend upward from the frame for engagement with the side marginal edges of the open pages of the book. A book support assembly is mounted on the frame for supporting a book in the book supporting plane; and this assembly includes means for supporting the spine portion of the book and spring means having laterally extending arms for urging the book covers toward the page holding arms in the book supporting plane. The book support assembly includes pivot means disposed in a central upright axis; and this support assembly pivot means and the frame pivot means coact to provide a rotary mounting for the support assembly through 180° relative to the frame. The holder is thereby adapted to support a book in the supporting plane in either of oppositely facing directions.

The novel features of the invention, as well as additional objects and advantages thereof, will be understood more fully from the following description when read in connection with the accompanying drawings.

DRAWINGS

FIG. 1 is a perspective view of a preferred form of book holder, according to the invention, with a supported open book shown in phantom lines;

Figure 2A:
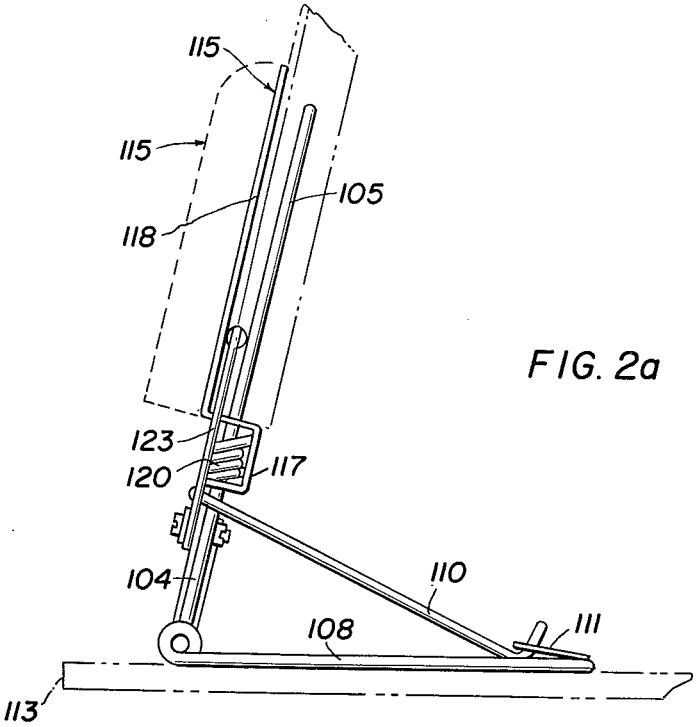
FIG. 2 is a side elevation view of the holder of FIG. 1, with the book supporting wings being shown in deflected position in dotted lines.
Figure 3:
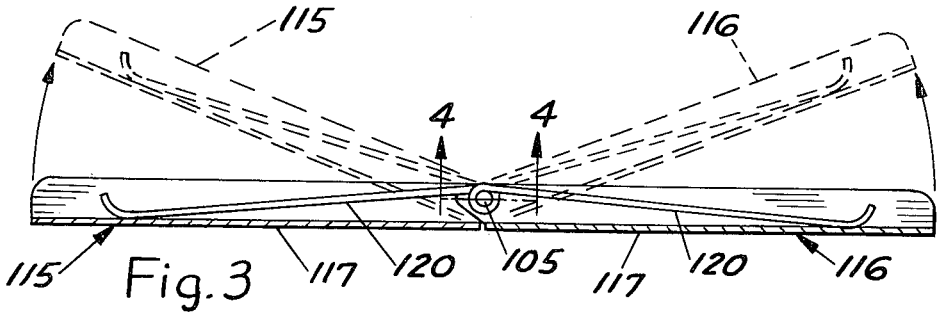
Figure 4:
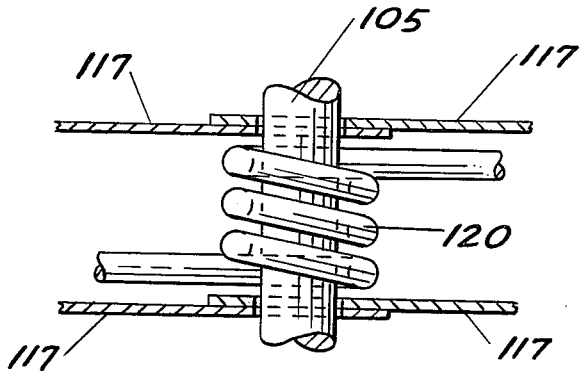
Figure 5:
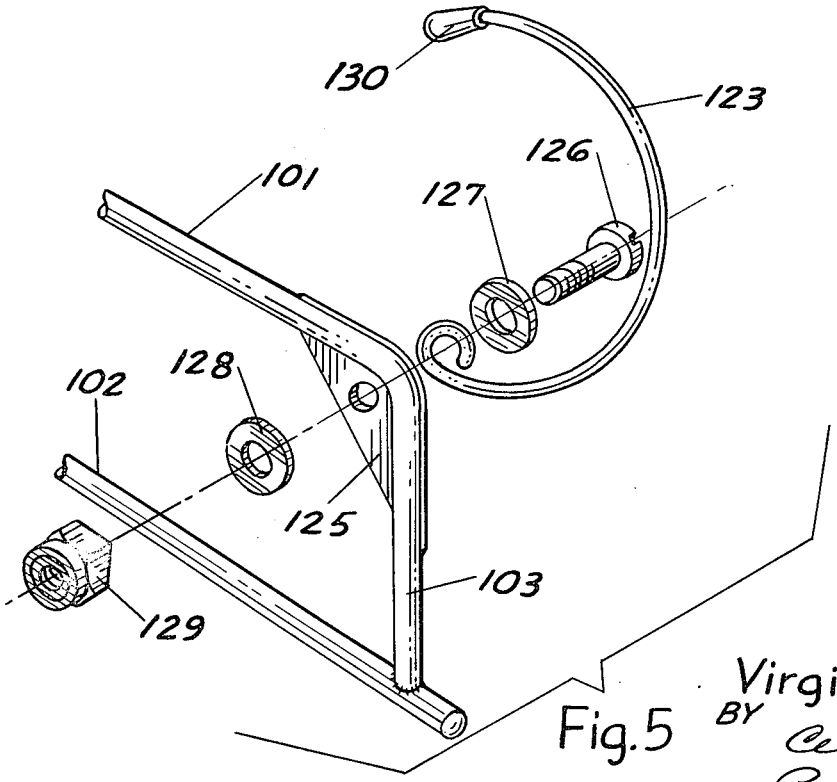

FIG. 2*a* is a side elevation view similar to FIG. 2 illustrating the supporting of a book, shown in phantom lines, in a forwardly inclined position for use by a person lying down FIG. 3 is a fragmentary sectional view taken in the plane 3—3 of FIG. 2, with the wings again being shown in a deflected position in dotted lines;

FIG. 4 is a fragmentary detail view taken in the plane 4—4 of FIG. 3, particularly illustrating the wing supporting spring;

FIG. 5 is an exploded detail view illustrating the mounting for one of the page holding arms.

Figure 8:
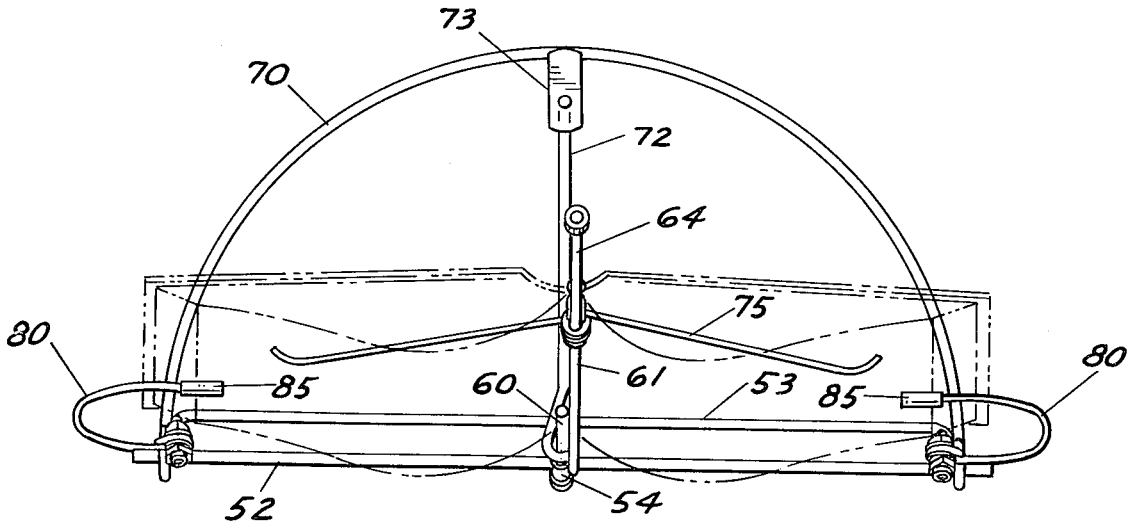
Figure 12:
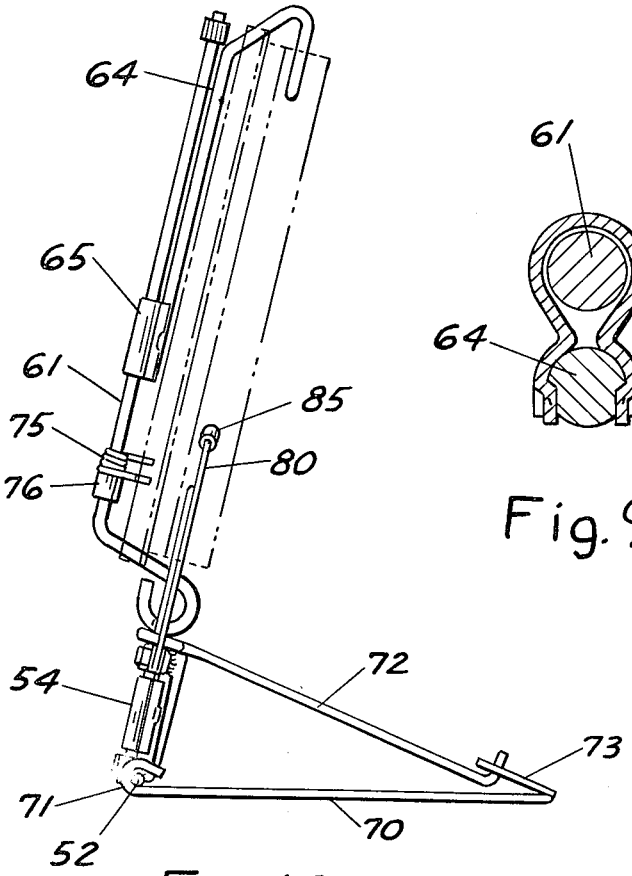
Figure 9:
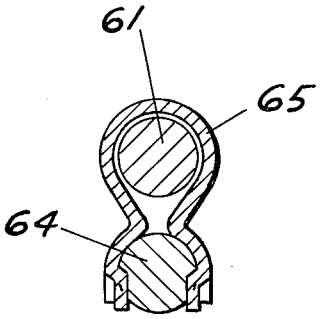
Figure 11:
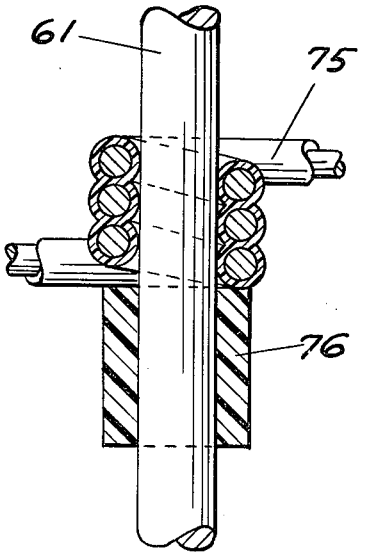

FIG. 6 is a perspective view of an alternative form of book holder, according to the invention, with a supported open book shown in phantom lines;

FIGS. 7 and 8 are respective side and top views of the book holder of FIG. 6 in the open condition;

FIG. 9 is a sectional view taken in the plane 9—9 of FIG. 7;

FIG. 10 is an exploded view of the means for attaching a page holding arm to the holder of FIG. 6;

FIG. 11 is a fragmentary detail view of the mounting for the book supporting spring arms in the holder of FIG. 6; and FIG. 12 is a side elevation view similar to FIG. 7 illustrating the supporting of a book, shown in phantom lines, in a forwardly inclined position for use by a person lying down.

DESCRIPTION OF THE EMBODIMENT OF FIGS. 1 THROUGH 5

In one preferred form of book holder, illustrated in FIG. 1 through 5, a frame 100 is a horizontally elongated rectangular frame consisting of upper and lower parallel horizontal members 101 and 102 and vertical end members 103 and 104 preferably fabricated of relatively heavy guage wire for example. The lower horizontal member 102 extends beyond the end members 103 and 104 to provide journals for the support base to be described.

An upright pin 105 is anchored to the lower and upper members 102 and 101, and extends upwardly therefrom in the plane of the frame. This pin 105 functions as a pivot pin for pivotally supporting the book support assembly to be described, and also functions as a part of the book supporting assembly to support a book supported on the book stand as will be described.

The frame 100 is generally planar, and its plane defines the book supporting plane of the holder. The frame is supported in a slightly inclined or natural reading position, by means of a support base or leg assembly which consists of a semi-circular shaped heavy gauge wire member 108 having loops or eyes 109 formed at its ends to define hinged couplings with the projecting journals of the frame member 102. With this hinged arrangement, when the book stand is not in use the support base 108 may be folded generally into the plane of the frame. A prop arm 110 connected between the frame pin 105 and a tab 111 welded to the support base 108 intermediate its ends, supports the frame at the desired angle relative to a supporting table or other surface 113. As seen in the drawings the prop arm is pivotally attached to the pin 105 so that it may be folded generally into the plane of the frame when the book stand is not in use. The tab 111 may be provided with two holes for receiving the bent tip of the prop arm 110 for the purpose of varying the support angle of the frame 100.

A book support assembly, which provides the principal support for the book, consists of a pair of wings 115 and 116 and spring arm member 120, with this assembly being pivotally mounted on the pin 105 to swing relative to the frame. The pin 105 which extends upwardly from the frame in the pivot axis, also functions as a part of the book support assembly, to assist in the book supporting function as will be described.

The wings 115 and 116 may be fabricated from a suitable sheet metal or plastic for example, and include lower channel portions 117 which define a shelf for supporting the lower edge of the book, and upward extending panel portions 118 which support the open covers of the book. As seen in the drawings, the parallel walls of the channel portions are provided with holes at one end adapted to receive the pin 105 and define the bearings for the hinged connection of the wing members about the pin. These channel portions interlock with each other at the pivot connection, to limit forward movement of the assembled wings beyond a common plane. This interlocking performs no function with respect to supporting a book, but merely retains the wings in a generally common plane for convenience of mounting a book on the holder and for convenience of storage. The panels 118 do not extend to the pivot axis, but have spaced vertical edges 118*a* defining a central gap of sufficient width to receive and accommodate the portion of a book at the binding which may form a projecting bulge when the book is in the open position on the holder.

A spring arm member 120 is provided for urging the wings 115 and 116 to this planar position, and also against page holding arms to be described; and consists of a spring wire having a helical coil formed intermediate its ends with two arms extending laterally at an obtuse angle relative to the axis of the helical coil. As best seen in FIGS. 3 and 4 the helical coil of the spring arm member is placed over the pin 105, and is assembled over the pin along with the wings 115 and 116 so that, in assembled relation, the spring member 120 is disposed within the channel portions of the wings.

As seen in FIG. 4, the spring coil is loosely received on the pin 105, providing complete freedom of the spring arms to urge the wings to the common planar position and permitting rearward deflection of the wings as best seen in FIG. 3. This loose relation of the spring coil also allows free rotation of the wings and spring arm assembly about the pin 105.

A pair of page holding arms 123 and 124 are generally U shaped wire members each having an eye formed at one end for pivotal attachment to the upper corners of the frame 100 to swing within the plane of the frame. The manner of attachment of these page holding members to the frame is best seen in FIG. 5. The frame is provided with corner gussets 125 providing bearing surfaces for the page holding arms. The arms are secured to the frame by means of an assembly which includes a headed bolt 126 passed first through a washer 127, then through the eye of the page holding member 123, then through a hole provided in the corner gusset 125 then through a second bearing washer 128, with this assembly being secured by a nut 129 which is preferably a form of lock nut. Desirably, the washers 127 and 128 may be formed of a resilient material to provide for some frictional resistance to pivoting of the page holding arms 123 and 124. Desirably, the free ends of the page holding members may be provided with protective tips 130 of plastic or rubber for example to protect the pages of the book.

It will now be seen that the book support assembly consisting of the wings 115 and 116 and the spring arm member 120 is freely rotatable about the pivot pin 105 relative to the frame 100; and is rotatable at least 180° between alternative positions coplanar with the frame 100. While the pin 105 is integral with the frame and this preferred embodiment extends upwardly and is generally co-extensive with the height of the wings and functions as a part of the book support assembly to support the book as will now be described.

In the use of this book holder, the frame 100 is locked relative to the support base 108 to select the desired support angle. With the holder disposed in the more usual rearwardly inclined position illustrated in FIGS. 1 and 2, the page holding arms 123 and 124 may be spread apart to permit the placing of the book 140, which is opened at the desired pages 141 and 142, on the shelf 117. The book covers are disposed in front of the panel portions 118, and the central or binding portion is placed behind the pin 105 as seen in FIG. 1 where the open page bases 141*a* and 142*a* pass behind the pin. The open pages of the book are then deflected rearwardly against the spring member 120, and the page holding arms swung inwardly and upwardly to engage the lower corners of the pages as best seen in FIG. 1. The pin 105, then, is received within the crease or juncture of the open pages of the book, indicated by the broken line 143; and with the book so confined between the pin 105 and the wings 115 and 116 lateral movement of the book is prevented during the turning of the pages. To turn a book page, for example, with reference to FIG. 1, the right hand portion of the book is depressed against the spring member and away from the arm 124, and page 142 is turned over the pin 105. The left side of the book is then depressed against the spring to secure the turned page under the arm 123. It will be seen then that the book 140 is firmly supported in the holder, and any desired number of pages may be turned in either direction without an interference from the pin 105.

The use of the holder in a forwardly inclined position is illustrated in FIG. 2*a;* and this use is to enable convenient reading by a person who is reclining, particularly a person who is confined to bed. For such use the holder would preferably be supported on a horizontal table supported on or over the bed. To achieve this position, the book 140 may be mounted on the book holder in the rearwardly inclined position in the manner described above. Then the assembly of the book and book support assembly may be pivoted relative to the frame, for example, by swinging the page holding arm 124 outwardly as indicated in the broken lines of FIG. 1 and rotating this assembly 180 degress clockwise by engaging page 141. The side pages will then swing around and engage the arm 123; and the arm 124 is then again pivoted inwardly to engage the page 141. In this forwardly inclined position, all of the parts of the book holder function identically, with the function of the spring arm member holding the pages against the arms 123 and 124 being assisted by gravity. In this position the pin 105 performs the additional function of holding the binding portion of the book against the wings against the force of gravity.

The wing panel portions 118 may be provided with suitable holes 119 for the purpose of conveniently carrying the frame while moving the frame from one place to another.

DESCRIPTION OF THE EMBODIMENT OF FIGS. 6 THROUGH 12

FIGS. 6 through 12 of the drawing illustrate another preferred form of book holder according to the invention, FIGS. 6, 7 and 8 being general views of the book holder supporting an open book in what is referred to as a "rearwardly inclined position" which would be the usual position when the holder is supported on a table or desk with the reader seated at the table or desk for example. FIG. 12 is a side elevation of the book holder, similar to FIG. 7 but illustrating the book as being held in a "forwardly inclined position" adapted for use by a person who is bedridden for example wherein the book would be supported on a bed table extending over the bed and could be read by a patient lying on his or her back.

The book holder illustrated in these figures includes a generally planar frame 50 and a spine assembly 51 which extends upwardly from the frame 50. Again, the frame is fabricated of relatively heavy gauge wire, as in the spine assembly.

The frame 50 is a horizontally elongated frame including a base member 52 and a flat U shaped member 53 having its ends welded to the base member adjacent to its ends, with the base member projecting outwardly from the welded joints. The frame also includes a central upright member to which is welded a sleeve member 54 to support the spine assembly 51 as will be described.

The spine assembly includes a straight base member 60 and an L shaped member 61, with the base of the L shaped member secured to the base member 60 intermediate its ends and with the upright leg of the L member extending generally parallel to the base member. The lower end of the base member 60 is received in the sleeve 54 to support the base member generally in the plane of the base frame 50, and the assembly of base member and L member defines an upward opening hook having a hook tip 62 for engaging and supporting the book at the bottom of the book binding or spine. An upper, downward opening hook member 64 with a hook tip 64*a* has a sleeve element 65 secured to its lower end, with the sleeve element being slidable on the upright leg of the L member 61. A stop member 66 at the upper end of the L member 61 limits upper movement of the upper hook member 64.

As seen in the figures, the confronting hook tips 62 and 64*a* are disposed generally in the plane of the frame, while the support for the spine of the book is defined by the upright arm of the L member 61 which is disposed in a plane spaced from the plane of the base. A support base is a semi-circular shaped wire member 70 having loops or eyes 71 formed at its ends to define hinged couplings with the projecting ends of the base member 52. A prop arm 72, connected between the spine base member 60 and a tab 73 welded to the base 70 intermediate its ends, locks the frame 50 and spine assembly 51 to an inclined plane relative to a horizontal supporting surface, with this plane being inclined rearwardly over the base 70.

For engaging and supporting the open covers of the book, a spring arm member 75 consists of spring wire having a helical coil formed intermediate its ends to be received over the upper arm of the spine L member 61 and retained on this L member adjacent to its base end. A stop member 76 may be positioned on the member 61 to assist in the positioning of the spring arm member. The oppositely extending arms of this spring member are aligned relative to each other at an obtuse angle so that they may urge the book covers forwardly toward the plane of the frame 50. The spring arm 75 may be coated with a suitable protective coating of plastic material for example.

The spine assembly 51 and the spring arm member 75, then, define a book support assembly which is pivotally mounted on the frame 50, the base member 60 being pivotally received in the aleeve 54.

The page holding arms 80 are U shaped wire members each having an eye 81 formed at one end for pivotal attachment to the upper corners of the frame base 50. The means for attaching these page holding members is best seen in FIG. 10 and includes a headed bolt 82 welded to the corner of the frame U member 53 and projecting forwardly. The eye 81 is secured on the bolt between two washers 83, and a nut 84 is threaded onto the bolt to secure the page holding arms with the desired amount of friction. These page holding arms 80 then swing within the plane of the frame 50 to selectively engage the pages of the book at the lower corners thereof. The free ends of the page holding arms may be provided with protective tips 85 of plastic or rubber for example to protect the pages of the book.

In use as seen in FIGS. 6, 7, and 8 the book 90 is inclined rearwardly when the holder is supported on a horizontal desk or table to position the book in a convenient reading position by a student, for example, seated at the desk or table. The book is supported at its spine, with the holder spine assembly disposed behind the book spine and with the hook tips 62 and 64*a* being disposed in the crease or juncture of the open book pages indicated by the broken line 93. The open pages, indicated by the broken lines 91 and 92, are urged against the arms 80 by the arms of spring 75. The book is conveniently held open at the desired page, for use by a student in preparing a report, for example; or the pages may be conveniently turned over the hook tips by first moving the book against the spring on one side, turning the page, and moving the book away from the arm 80 on the other side to secured the turned page.

To position the book in the forwardly inclined position, as seen in FIG. 12, the support assembly 51, 75 is rotated within its sleeve 54 to position the hooks 62 and 64 and the spring arm 75 in a rearward facing position; and the book is turned around so that its pages bear against the page holding arms 80 from the front or opposite sides thereof. With this arrangement the open pages of the book are inclined forwardly so that it may be supported on a horizontal table above a patient lying on his or her back, and the book may be read rather easily then by a patient who is not able to sit up.

It will be seen that all of the parts of the holder are foldable, when not in use, to lie generally within the plane of the frame base 50 for ease of storage.

Particular advantages and features of the above described book holders are the lighweight construction providing for convenience of use and portability, the design providing for disassembly and foldability which affords a compact device for purposes of storage in a desk drawer, for example. Another feature of the holder is that in use, the pages of the book are readily flipped singly in a convenient manner, and yet the page holders may be readily moved out of the way for reference back or forward to a different portion of the book without removing the book from the holder.

A particular feature of the book holder, in either form described, is that it is reversible to support a book in either a rearwardly inclined or forwardly inclined position for use alternatively by a person seated at a table, or by a person who desired to or is required to read from a reclined position.

Although the invention has been described with reference to particular preferred embodiments, many changes and modifications will become apparent to those skilled in the art in view of the foregoing description which is intended to be illustrative and not limiting of the invention defined in the claims.

What is claimed is:

1. A holder for supporting a book in open reading position comprising a base assembly comprising a horizontally elongated frame defining a supporting plane for an open book, including pivot means disposed in a central upright axis in said supporting plane; and support means mounted on said frame for supporting said frame, on a horizontal surface, in a reading plane inclined from a vertical plane;

a pair of page holding arms pivotally mounted adjacent to respective ends of said frame, to swing within the book supporting plane; said arms being disposed and formed to extend upward from said frame for engagement with the side marginal edges of the open pages of the book;

a book support assembly rotatably mounted on said base assembly for supporting a book in the book supporting plane; said book support assembly including means for supporting the spine portion of the book, and spring means having laterally extending arms for urging the book covers toward said page holding arms in the book supporting plane;

said book support assembly including pivot means disposed in a central upright axis; and said support assembly pivot means and said base assembly pivot means coacting to provide a rotary mounting for said support assembly through 180° relative to said base assembly; said holder being thereby adapted to support a book in the book supporting plane in either of oppositely facing directions.

2. A book holder as set forth in claim 1 including a book supporting center pin projecting upwardly from said frame in said central pivot axis, for engagement with the open face of the book between the pages.

3. A book holder as set forth in claim 1 said frame being fabricated from wire members; said support means comprising a generally curved wire member having its ends pivotally connected adjacent to the ends of said frame; and a wire support arm pivotally connected between said curved member and said frame, intermediate the ends thereof, for propping said frame at a predetermined angle relative to said support means to define the angle of the supporting plane for said book holder.

4. A book holder as set forth in claim 1 said page holding arms comprising curved wire members pivotally mounted at one end on said frame, and curving toward each other at the distal ends for engagement with the pages of the book.

5. A book holder as set forth in claim 1 said book support assembly including means defining a central pivot axis, and a pair of oppositely extending wing members hingedly mounted about said central pivot axis; said wing members including means for supporting the lower edges of the book and respective panels for supporting the book covers;

and said spring means coacting with said wing members to urge said wing members toward said page holding arms.

6. A book holder as set forth in claim 5 a book supporting center pin projecting upwardly from said frame in said central upright axis, for engagement with the open face of the book between the pages;

said pin defining said frame pivot means, and said wing members and said spring means being rotatably mounted on said center pin.

7. A book holder as set forth in claim 6 said wing member panels being spaced laterally from each other defining parallel confronting edges to accommodate and support the spine of a book; and said frame center pin being disposed to engage the open face of the book between the pages.

8. A book holder as set forth in claim 6 said wing members including integral, horizontal laterally facing channel portions at the lower edges defining a lower supporting shelf; each of said channel portions having transversely aligned holes at one end thereof for receiving said center pin, and defining hinge means for said wing members;

said spring means comprising a helical coil and integral oppositely extending transverse arms; and said spring means coil being received on said center pin with said spring arms being received within respective channel portions of said wing members.

9. A book holder as set forth in claim 1 said support assembly including a generally vertical spine having lower and upper hook means for engaging respective lower and upper edges of said book at the spine thereof; said upper hook means being slidable on said spine relative to said lower hook means.

10. A book holder as set forth in claim 9 said spring means comprising a helical coil and integral oppositely extending transverse arms; and said spring means being rotatably mounted on said support assembly spine.

* * * * *